US012345013B2

(12) United States Patent
Sanchez Gomez et al.

(10) Patent No.: US 12,345,013 B2
(45) Date of Patent: Jul. 1, 2025

(54) SHAKER FOR GENTLE DRIVING OF PILES

(71) Applicant: TECHNISCHE UNIVERSITEIT DELFT, Delft (NL)

(72) Inventors: Sergio Sanchez Gomez, Delft (NL); Andrey Vladimirovich Metrikine, Delft (NL)

(73) Assignee: TECHNISCHE UNIVERSITEIT DELFT, Delft (NL)

( * ) Notice: Subject to any disclaimer, the term of this patent is extended or adjusted under 35 U.S.C. 154(b) by 170 days.

(21) Appl. No.: 17/638,585

(22) PCT Filed: Aug. 28, 2020

(86) PCT No.: PCT/NL2020/050532
§ 371 (c)(1),
(2) Date: Feb. 25, 2022

(87) PCT Pub. No.: WO2021/040523
PCT Pub. Date: Mar. 4, 2021

(65) Prior Publication Data

US 2022/0290396 A1 Sep. 15, 2022

(30) Foreign Application Priority Data

Aug. 28, 2019 (NL) ..... 2023723

(51) Int. Cl.
*E02D 7/18* (2006.01)

(52) U.S. Cl.
CPC ..... *E02D 7/18* (2013.01)

(58) Field of Classification Search
CPC ..... E02D 7/18; B06B 1/161
USPC ..... 173/1–2, 13, 18–20, 184, 29–31, 38–39, 173/45–53, 90
See application file for complete search history.

(56) References Cited

U.S. PATENT DOCUMENTS 2,440,834 A * 5/1948 Sims, Jr. ..... B25B 21/026 173/13
3,199,614 A 8/1965 Bodine
3,205,721 A * 9/1965 Speer ..... B23D 51/16 30/392
3,280,924 A * 10/1966 Pavlovich ..... E02D 7/18 74/61
3,383,531 A * 5/1968 Gafencu ..... E02D 7/18 318/35

(Continued)

FOREIGN PATENT DOCUMENTS

DE 3716431 A1 11/1987
DE 4021278 A1 1/1992

(Continued)

OTHER PUBLICATIONS

International Search Report and Written Opinion; PCT Patent Application No. PCT/NL2020/050532; dated Oct. 16, 2020; 13 pages.

*Primary Examiner* — Robert F Long
(74) *Attorney, Agent, or Firm* — AEON Law, PLLC; Adam L. K. Philipp; Charlotte E. Holoubek

(57) ABSTRACT

The present invention is in the field of piles used for supporting buildings and the like. Piles can be used as support, for onshore or offshore structures such as tall buildings and wind turbines. The present invention is in particular suited for driving small- and mid-scale piles, which are often used in softer, non-cohesive, soils, such as sandy soils.

14 Claims, 4 Drawing Sheets

(56) References Cited

U.S. PATENT DOCUMENTS 3,433,311 A * 3/1969 Lebelle ..... E02D 11/00 74/61
3,564,932 A * 2/1971 Lebelle ..... B06B 1/166 74/61
3,583,497 A 6/1971 Kossowski et al.
4,113,034 A * 9/1978 Carlson ..... E02D 7/18 74/61
4,121,702 A * 10/1978 Kaufmann ..... B61H 7/04 188/42
4,471,666 A * 9/1984 Unrath ..... B06B 1/166 74/61
4,603,748 A * 8/1986 Rossfelder ..... B06B 1/166 74/61
4,673,043 A * 6/1987 Greppmair ..... B25D 17/11 173/211
6,604,583 B1 * 8/2003 Van Randen ..... E02D 7/18 173/1
7,168,890 B1 * 1/2007 Evarts ..... E02D 7/18 405/232
7,568,529 B2 * 8/2009 Nonaka ..... B06B 1/16 173/51
7,704,017 B2 * 4/2010 Evarts ..... F16D 1/0847 405/232
10,022,848 B2 * 7/2018 Gross ..... B25F 5/00
2004/0022582 A1 * 2/2004 Sick ..... E01C 19/38 404/133.05
2007/0017684 A1 * 1/2007 Stirm ..... B25D 17/24 173/210
2010/0162579 A1 * 7/2010 Naughton ..... B23D 49/16 30/392
2013/0199812 A1 * 8/2013 Dangelmaier ..... F02D 31/001 173/179
2016/0023342 A1 * 1/2016 Koenig ..... B25C 1/06 173/124
2018/0161818 A1 * 6/2018 Kwak ..... B06B 1/166
2019/0247888 A1 * 8/2019 Houston ..... H02K 33/00
2020/0325763 A1 * 10/2020 Veltman ..... G05B 15/02
2020/0398355 A1 * 12/2020 Mougeotte ..... B23D 51/10

FOREIGN PATENT DOCUMENTS

DE 102004013790 A1 10/2005
DE 202007018580 U1 * 1/2009 ..... E02D 11/00
DE 102011103401 A1 * 12/2012 ..... E02D 7/18
EP 0025408 A2 * 3/1981
EP 0116164 A1 * 8/1984
EP 0840191 A1 * 5/1998
GB 687603 A 2/1953
GB 1066247 A * 4/1967
GB 1363205 A * 8/1974 ..... E02D 3/074
JP S63161939 U * 10/1988
WO WO-2024112191 A1 * 5/2024 ..... E02D 13/10

* cited by examiner

Pos1
Pos2
F5
F6
w1
z
y

Pos1
Pos2
Pos3
Pos4
Z
Mt
F1
F2
F3
F4
w2
X

SHAKER FOR GENTLE DRIVING OF PILES

RELATED APPLICATIONS

This application is a U.S. National Phase of PCT Patent Application No. PCT/NL2020/050532 having International filing date of Aug. 28, 2020, which claims the benefit of priority of Dutch Patent Application No. 2023723 filed on Aug. 28, 2019. The entire contents of the above-referenced applications and of all priority documents referenced in the Application Data Sheet filed herewith are hereby incorporated by reference for all purposes.

FIELD OF THE INVENTION

The present invention is in the field of pile used for supporting buildings and the like. Piles can be used as support for onshore or offshore structures, such as tall buildings and wind turbines. The present invention is in particular suited for driving small- and mid-scale piles, which are often used in softer, non-cohesive, soils, such as sandy soils.

BACKGROUND OF THE INVENTION

The present invention is in the field of pile driving. Typically piles are driven into the soil using hammers or weights dropping repeatedly on top of the pile. In regions with relatively soft soils, or where piles are needed as supports for man-made structures or the like, a relatively large number of piles is driven into the soil. This driving causes noise nuisance to the environment. In addition such driving inflicts forces on the pile, which may weaken or damage the pile.

GB 1066247 (A) recites a vibratory-hammer for driving members, such as piles, having a vertical and rotary action and comprising two shafts mounted on a support housing, and provided with gears and discs, the gears and discs being fitted with weights so that, upon rotation of the shafts in opposite directions, they exert a vibratory turning moment on the support housing thereby rotating it and at the same time, causing a percussive member to strike an anvil portion of the housing. The document is more concerned with drilling using rotational vibration of the pile around a horizontal axis (somewhat confusingly referred to as torsion). In addition the rotation of the respective masses is coupled (see FIGS. 1-4) and takes place at comparable frequencies. The present invention therefore relates to an improved pile driver and a method for driving piles, which solves one or more of the above problems and drawbacks of the prior art, providing reliable results, without jeopardizing functionality and advantages.

SUMMARY OF THE INVENTION

It is an object of the invention to overcome one or more limitations of pile drivers of the prior art and methods of driving piles and at the very least to provide an alternative thereto. The present invention may be considered to relate to a shaker causing torsional vibrations with around a vertical axis, in combination with vertical vibration. The torsional vibrations typically take place at a much higher frequency that the vertical vibrations and are considered to continuously break static friction of the pile with surrounding soil. As the coupling is broken the vertical vibration drives the pile into the soil (see e.g. FIGS. 4-6). In a first aspect the present invention relates to a shaker for gentle pile driving comprising a fixator for mechanically fixing a vibrator to a pile, and thus for transferring vibrational energy to the pile, a vibrator adapted to provide vertical vibration of the pile at a first vibration frequency and torsion to the pile at a second, typically much higher, torsion frequency, wherein the vibrator comprises at least two groups i≥2 of eccentric masses, each group i comprising at least two equal masses j, wherein each individual mass $m_{i,j}$ is positioned at a distance $d_i$ from the vibrator, typically a distance parallel to a rotation axis, such as at a distance d1 and d2, wherein the mass $m_{i,j}$ is attached to at least one horizontal axis $ha_i$, at least one motor for rotating the masses $m_{i,j}$ around their horizontal axis $ha_i$, such that in a group i masses $m_{i,j}$ rotate at a same angular velocity $\omega_i$ along said horizontal axis $ha_i$, wherein angular velocity $\omega_i$ is different from angular velocity $\omega_{i+1}$, typically wherein the torsion frequency is larger than the vertical vibration frequency, typically several times larger, and in a group i+1 masses $m_{i+1,j}$ rotate at an opposite angular velocity $\omega_{i+1}$ along said horizontal axis $ha_{i+1}$, and a controller for driving the at least one motor, for controlling each individual angular velocity $\omega_i$ of group i of masses $m_{i,j}$, for controlling a sum of horizontal forces produced by the respective masses (e.g. F1-F4 in FIG. 6), and for balancing a sum of vertical forces produced by the respective masses (e.g. F1-F4 in FIG. 6, typically combined with F5-F6). In addition to these forces gravity pulls the mass of the pile downwards. As such the controller may balance forces in the z-direction, and sum forces in the x-direction (or equivalently, in the y-direction, or in a combined x+y-direction), the z-direction being parallel to the axis of the pile, and the x- and y-direction being perpendicular to the axis of the pile, such as in a Cartesian set of axes. The shaker can drive piles into the soil by means of torsional vibration, typically at high frequencies, in combination with vertical vibration, typically at lower frequencies. No further driving means are required, such as a hammering device. Thereto the eccentric masses rotate at typically high speed. Typically the masses are positioned such that at a specific position they generate two forces of opposite directions creating a moment in the torsional direction, along the longitudinal axis of the pile, and zero forces in another position. The shaker, and the present method, are more rapid and less noisy. For instance for a midsized pile of e.g. 10 m length and with a diameter of about 75 cm the pile is driven about twice as fast compared to prior art techniques. The pile may move downward with a speed of some 30 cm/second. In addition no or less deformation of the pile is achieved, compared to an impact hammer. The energy generated by the present shaker is mainly used for driving the pile.

In a second aspect the present invention relates to a method of driving a pile into a soil, comprising mounting providing a shaker according to the invention, mounting the shaker on a pile, typically firmly attaching and/or fixating the shaker to the pile, and driving the pile into the soil. It has been found that surprisingly the pile can be driven into the ground using significantly less energy, and at a noise level that hardly disturbs the environment, such as <60 dB.

Advantages of the present description are detailed throughout the description.

DETAILED DESCRIPTION OF THE INVENTION

In an exemplary embodiment of the present shaker a center of mass of the shaker and a rotation axis of the pile may coincide, typically within a few %, such as within 5%.

In an exemplary embodiment of the present shaker may comprise a least one gear adapted to be driven by the at least one motor and adapted to rotate at least one mass preferably two masses within one group i. Therewith good and simple control of forces can be achieved, as well as adaption of forces during pile driving. In an example masses of different groups may be driven by the same gear.

In an exemplary embodiment of the present shaker a first group may comprise a mass $m_{1,1}$ and a mass $m_{1,2}$, a second group may comprise a mass $m_{2,1}$ and a mass $m_{2,2}$, and optional further groups may comprise a mass $m_{i,1}$ and a mass $m_{i,2}$. So a large variety of masses may be used, as well as a number of groups. Typically, in view of simplicity of construction only a limited number of groups is used, such as two, but the invention is not limited thereto.

In an exemplary embodiment of the present shaker the controller may be adapted to control the sum of vertical forces of the groups to be cancelled. By varying angular velocity and typically by carefully selecting and balancing masses, and radius and/or distance, the sum of vertical forces is cancelled. Such results in a very steady mode of operation with a minimum amount of noise.

In an exemplary embodiment of the present shaker the horizontal forces may be controlled to be added. As with the vertical forces, horizontal forces can be controlled by varying angular velocity and typically by carefully selecting and balancing masses, and radius and/or distance.

Also, vertical forces may still be generated, such as at low frequency. In any case the mass of the pile, and gravitational force, in combination with the torsion, drives the pile into the soil.

In an exemplary embodiment of the present shaker in an $i^{th}$ group a first mass $m_{i1}$ may be located at a first distance $d_i$ from a vibrator side and a second mass $m_{i,2}$ may be located at the same first distance $d_i$ from a vibrator side opposite of the first mass. In a group masses are typically located "opposite" of one and another, with respect to the position of the vibrator.

In an exemplary embodiment of the present shaker the at least one motor may be each individually adapted to rotate horizontal rotation axes hat at 10-200 Hz (600-12000 rpm), preferably at 20-180 Hz, more preferably at 30-150 Hz, even more preferably at 40-120 Hz, such as at 50-100 Hz, e.g. 60-80 Hz.

In an exemplary embodiment of the present shaker at least one first motor may each individually be adapted to rotate horizontal rotation axes hat at a first vibration frequency of 10-50 Hz (600-3000 rpm), preferably at 12-30 Hz, more preferably at 15-25 Hz, such as at 16-24 Hz.

In an exemplary embodiment of the present shaker at least one second motor may each individually be adapted to rotate horizontal rotation axes hat at a second torsion frequency of 15-200 Hz (900-12000 rpm), preferably at 30-150 Hz, more preferably at 50-100 Hz, such as at 60-80 Hz.

In an example the first vibration frequency may be 1400 rpm and the second torsion frequency may be 4800 rpm.

In an exemplary embodiment of the present shaker at least one second angular torsion velocity $\omega_i$ may be at least two times first angular vibration velocity $\omega_{1+1}$, preferably wherein at least one angular velocity $\omega_i$ is at least four times angular velocity $\omega_{i+1}$, more preferably at least ten times, such as at least 50 times.

In an exemplary embodiment of the present shaker masses $m_{i,1}$ and $m_{i,2}$ may be located at a distance $e_i$ from horizontal rotation axis $ha_i$, and wherein masses $m_{i+1,1}$ and $m_{i+1,2}$ may be located at a distance $e_{i+1}$ from horizontal rotation axis $ha_{i+1}$.

In an exemplary embodiment of the present shaker wherein masses $m_{i,j}$ may be disc-shaped with a radius of $e_i$ and wherein a center of mass of the disc-shaped mass coincide with the rotation axes hat, respectively. Therewith a well-balanced mass may be provided.

In an exemplary embodiment of the present shaker the ratio of masses $m_{i+1,1}/m_{i,1}$ may be equal to $e_i/e_{i+1}$. Therewith forces of an $i^{th}$ group and an $i+1^{th}$ group can be balanced, typically well within 1% or better, such as fully balanced.

In an exemplary embodiment the present shaker may comprise two groups of masses, wherein the horizontal rotation axes $ha_1$ and $ha_2$ are at equal distance from a central point of the shaker. Therewith forces of an $i^{th}$ group and an $i+1^{th}$ group can be balanced.

In an exemplary embodiment of the present shaker masses may be disc shaped. Such is found to be easily attached to the axes.

In an exemplary embodiment of the present shaker the masses may be 5-5000 gr, preferably 10-1000 gr, such as 30-600 gr, e.g. 50-400 gr. For larger piles and/or heavier soils and/or stiffer soils larger masses may be used. In addition, or as alternative, angular velocities may be increased.

In an exemplary embodiment of the present shaker the distance/radius $e_i$ is 1-50 cm, preferably 2-40 cm, such as 3-30 cm.

In an exemplary embodiment of the present shaker the controller may drive the at least one motor in phase, for instance such that $F_{z1}=-F_{z2}$, typically well within 1% accuracy, such as fully equal of size.

In an exemplary embodiment of the present shaker the shaker may comprise a receiving structure, such as a groove. Therewith the pile can be firmly attached to the present vibrator.

In an exemplary embodiment of the present shaker the controller may be adapted to provide a vertical driving frequency of 10-50 Hz.

In an exemplary embodiment of the present method the vibrator is calibrated before driving the pile into the soil. As such driving forces, angular velocities, soil properties, interaction between pile and soil, and so on, can be controlled better.

The invention will hereafter be further elucidated through the following examples which are exemplary and explanatory of nature and are not intended to be considered limiting of the invention. To the person skilled in the art it may be clear that many variants, being obvious or not, may be conceivable falling within the scope of protection, defined by the present claims.

DETAILED DESCRIPTION OF FIGURES

Figure 1:
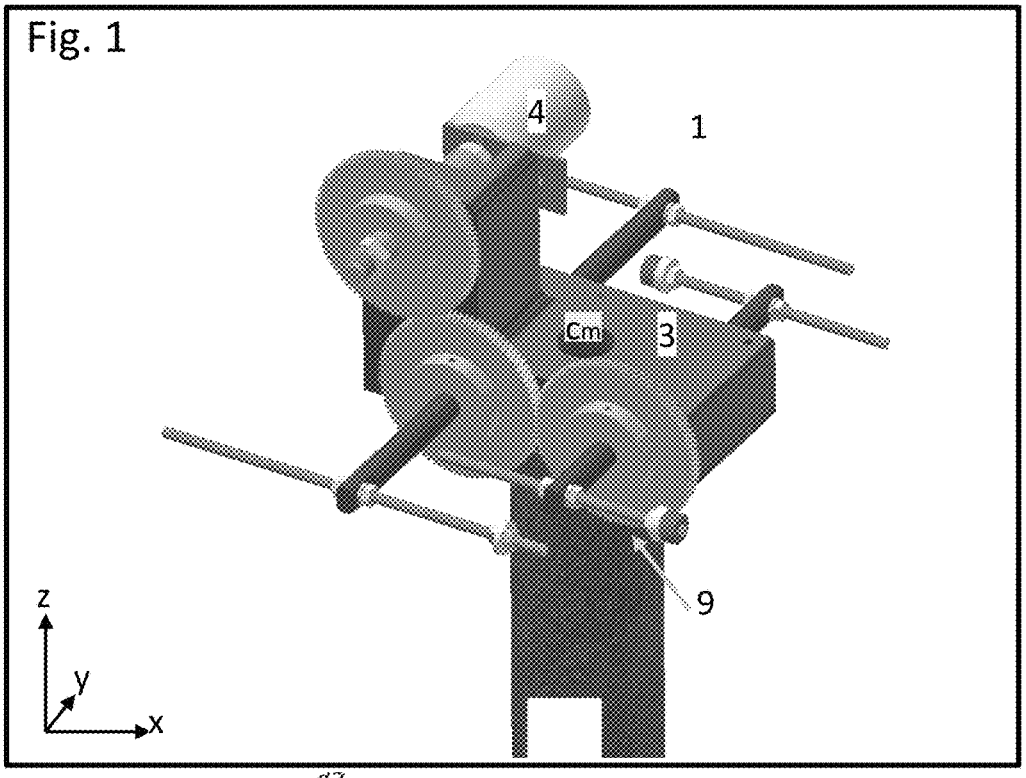
FIGS. 1, 2, 3*a-d* show some details.

In the figures:

1 shaker
2 axle
3 vibrator
4 motor
8 bearing
9 fixator
18 gear
21 clamp
22 axle

25 gear
26 clamp
27 engine
29 gear
31 safety clamp
32 ball bearing
33 spacer
34 spacer
35 clamp
36 supporting plate
43 fixation
$d_i$ distance i of masses $m_{i,j}$ of group i from a vibrator side
$e_i$ distance i of masses $m_{i,j}$ of group i from a horizontal rotation axis $ha_i$
$ha_i$ horizontal axis for masses of group i
$m_{i,j}$ mass j of group i
$\omega_i$ angular velocity of masses of group i
P pile FIG. 1 shows an example of a prototype of the present shaker mounted on a pile. The main block was machined as to accommodate the main components of the shaker (motor, gears, axles and masses) in an efficient way and to ensure that the centre of masses falls in the desired place. The shaker consists of a motor that provides the input energy. Three gears are used to transfer the forces from the motor to the two axles that contain four eccentric masses in total, two per axle. When the masses start rotating centrifugal forces are generated and these are transfer to the pile in the form of a torsional moment.

Figure 2:
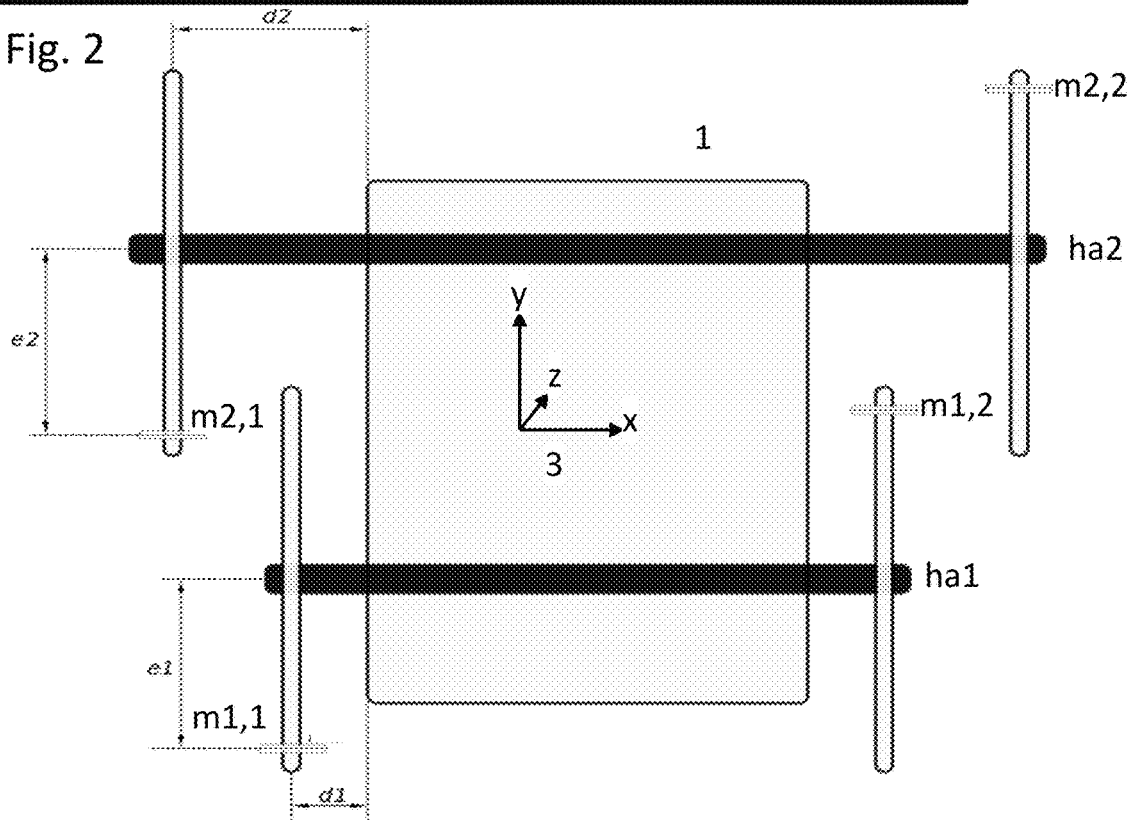

FIG. 2 shows a top view sketch of the prototype shaker that reveals the relative spatial positions of masses and principal distances ($d_1$, $d_2$, $e_1$, $e_2$) from the block. Examples Here details of a design and functioning of a small scale shaker are described. Also an explanation of how the shaker works is given, as well as a technical drawing with an overview of the mechanical components of the shaker, a description of a frequency controlling system of the electrical motor, a parametric study of the expected forces and moments generated by the shaker is shown, and some safety recommendations and instructions are addressed.

The shaker is designed to be mounted on the top of a small scale pile P as shown in FIG. 1. The shaker generates forces by means of counter-rotating masses displaced certain distance from the centre of rotation. And, pairing this forces with another's of the opposite sign a moment is generated. This moment is only effective about the z-axis according to FIG. 1. This means that the moment only applies when the masses are in the position shown in FIG. 1, and rotated 180 degrees with respect to the drawn position. This generates a harmonic torsional moment that is transferred to the top of the pile P. The system is driven by an electrical motor frequency controlled. Also a feedback loop may be provided, providing actual force and/or angular rotation as measured, comparing said measurement with present values, and optionally correcting for measured variation, such as by increasing or decreasing the angular velocity. Such may be done for the total system, or for parts thereof, such as for a group of masses i. Moreover, the masses and the positioning is variable. This gives us enough flexibility to generate the desired moment. The components were selected such that enable the correct functioning of the shaker for a long period of time. The FIG. 3 depicted below shows the technical details of the final prototype design of the shaker.

The force $F_z$, created by one rotating mass is cancelled out at all θ by the force generated in the other axle that runs in counter phase, and the same happens in the other part of the axles. In the case of $F_x$, the force is cancelled out in all θ, but at 0 and 180 degrees, where $F_x$ is maximum. Given the fact that the two masses on one side are displaced 180 degrees with respect to the two masses on the other side, a moment about the z-axis is generated. The reason for using two masses at each side of the shaker is to eliminate the moment generated about the x-axis, when the masses are at 90 and 270 degrees with respect to the origin (which is considered to be in the position shown in the drawing). Given that, the eccentric distances are different the masses have to necessarily be different as well. Considering that the axles are aligned in the x-direction no moment about the y-axis is expected. Finally, the force and moment development in the whole envelope is shown in the following figures as an example for a specific case study.

The FIG. 2 represents the shaker and describes the parameters of interest for the analysis. For the case study the following values are selected: $m_1$=10 gr, $e_1$=5 cm, $e_2$=8 cm, $d_1$=10 cm, $d_2$=15 cm, and $m_2=m_1e_1/e_2$=6.3 gr. The mass m2 is computed such that the resultant moment about the x-axis is zero given that the distances $d_1$ and $d_2$ have to be different for practical reasons of spacing. The resultant decomposed forces in the x-direction are as a consequence summed, whereas the decomposed forces in the z-directions cancel one and another and are 0 in total.

In the FIG. 3*a-d* the components that compose an example of the present prototype shaker are enumerated and hereafter a description of the utility of each component in the shaker is given.

Component 27 corresponds to the engine that provides the power and enables the moving of the eccentric masses. Components 43 and 36 consist of a supporting plate and fixations for the engine that ensures the correct positioning of the engine shaft with the driving axle gear, 29, and the clamping, 35, to avoid slippage between the engine shaft and the driving axle. A train of gears, 18 and 25, is used to transfer the engine torque to the axles, 2 and 22. To ensure the correct alignment between the gears a safety clamp is used in the powered gear, 31. A clamp, 26, is used to ensure the eccentric masses are kept in place during the movement of the axles. In the side view of the figure, components, 8 and 21, consist of the bearing and clamps respectively.

Figure 3A:
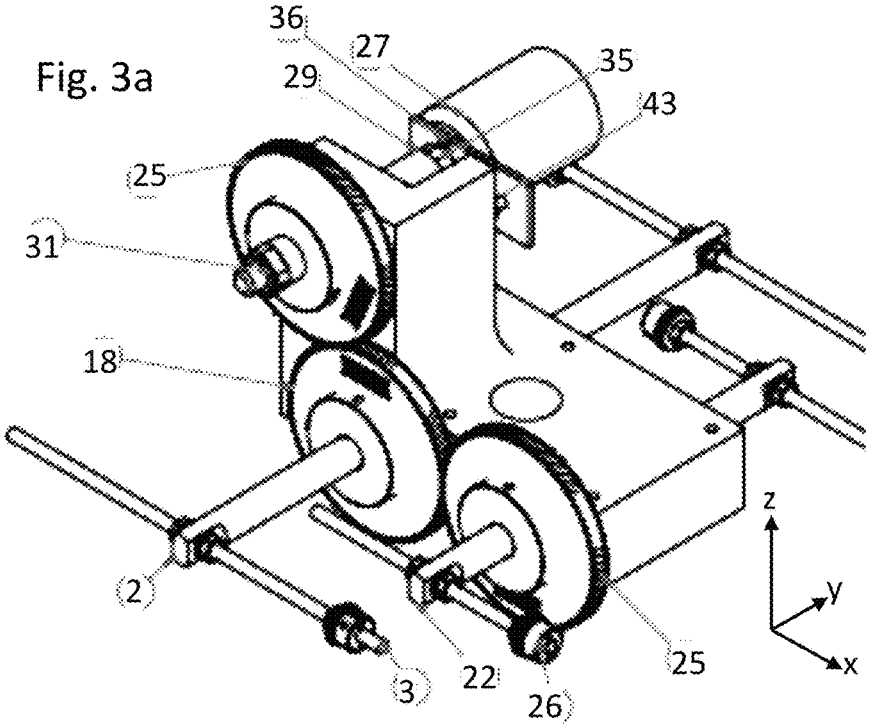
Figure 3B:
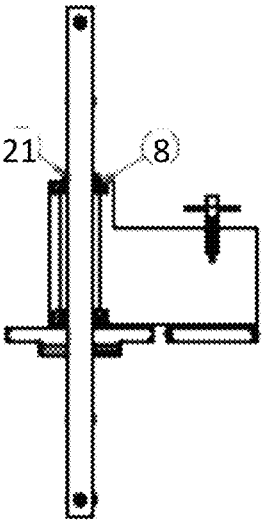
Figure 3C:
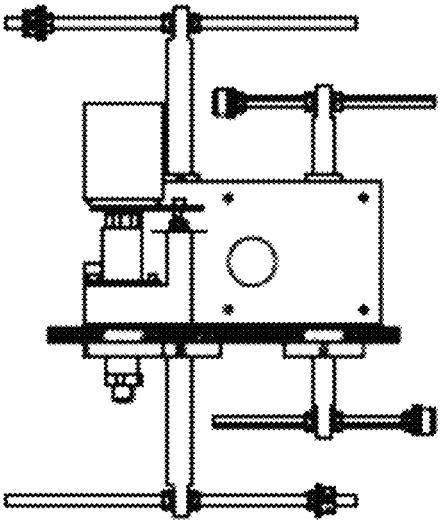
Figure 3D:
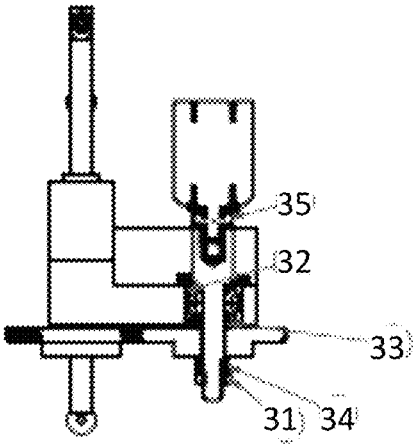

FIG. 3*c* shows the top view of the shaker. Component 32 consists of a ball bearing to allow the rotation of the engine axle, and, components 33 and 34 consist of spacer rings to ensure the correct coupling between the components of the power train.

The motor of the shaker can reach high speeds, therefore, it typically is extremely important to take some safety measures before activating the shaker. 1.—The exchangeable parts such as the added masses and constraining bolts have to be ensured in order not to fly away during operation. Even then, during operation some protections should be provided and no person should stand close to the shaker. 2.—The simulated maximum force generated by the shaker during operation on the axles is: 400 N (per eccentric weight). Any misalignment can cause a small bending of the axle making the shaker unstable and its behaviour unpredictable. It is therefore preferred to use disc-shaped masses with a center of mass and rotation axis coinciding, or to use two equal masses at equal distance from the axis. 3.—The gears are fixed to the axles by a set screw. To avoid scratching the axle a small piece of copper is placed between the set screw and the axle. Care should be taken when the gear is removed that the piece of copper doesn't fall out. 4.—The axle of the motor is clamped in the drive axle by a clamp nut (MLN8). Prescribed tightening torque is 24.5 Nm.

Herewith a lab-scale pile was driven into the soil multiple times, without any problem.

Figure 4:
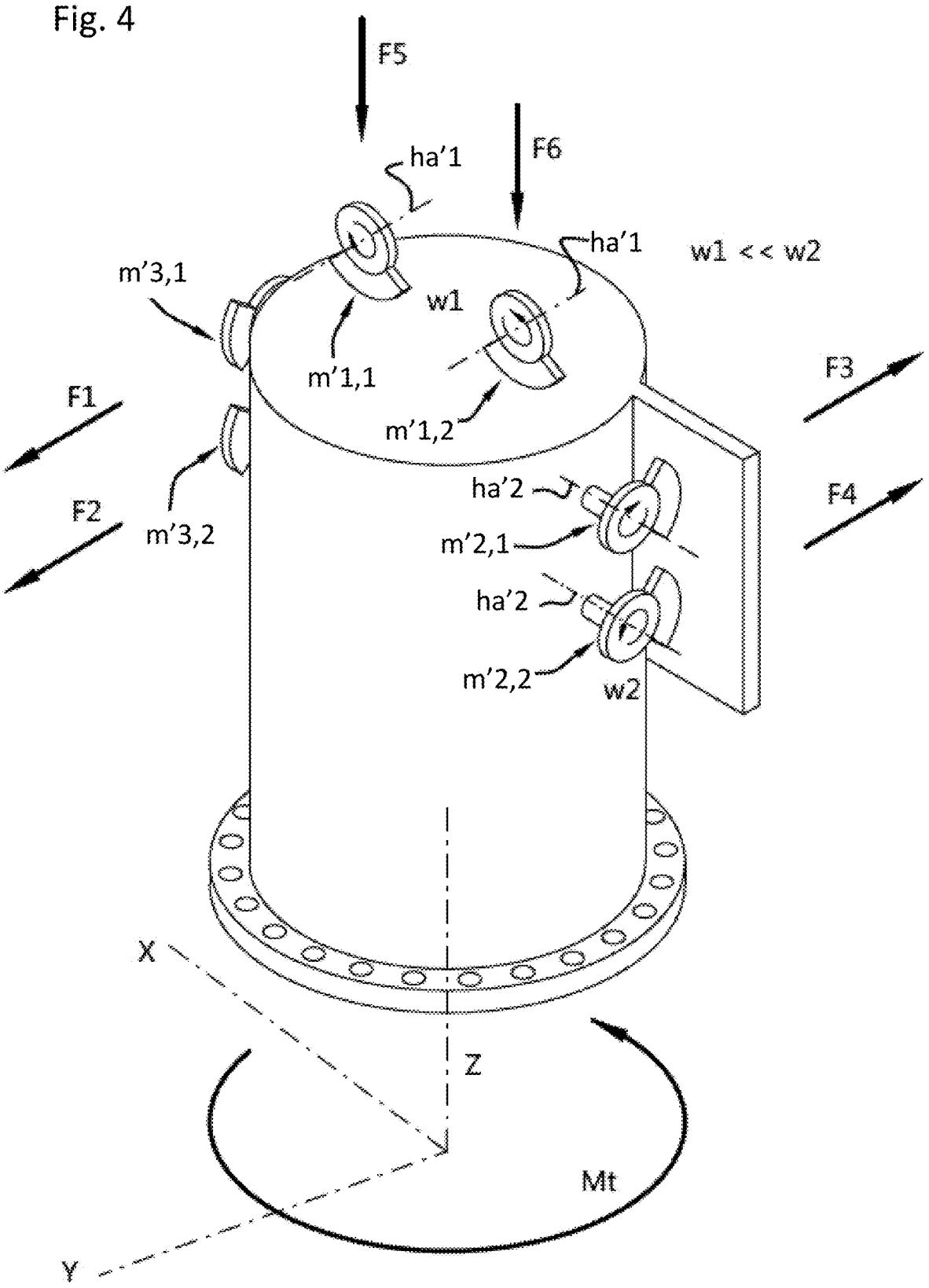
FIGS. 4-5 show the present shaker and forces obtained.
Figure 5:
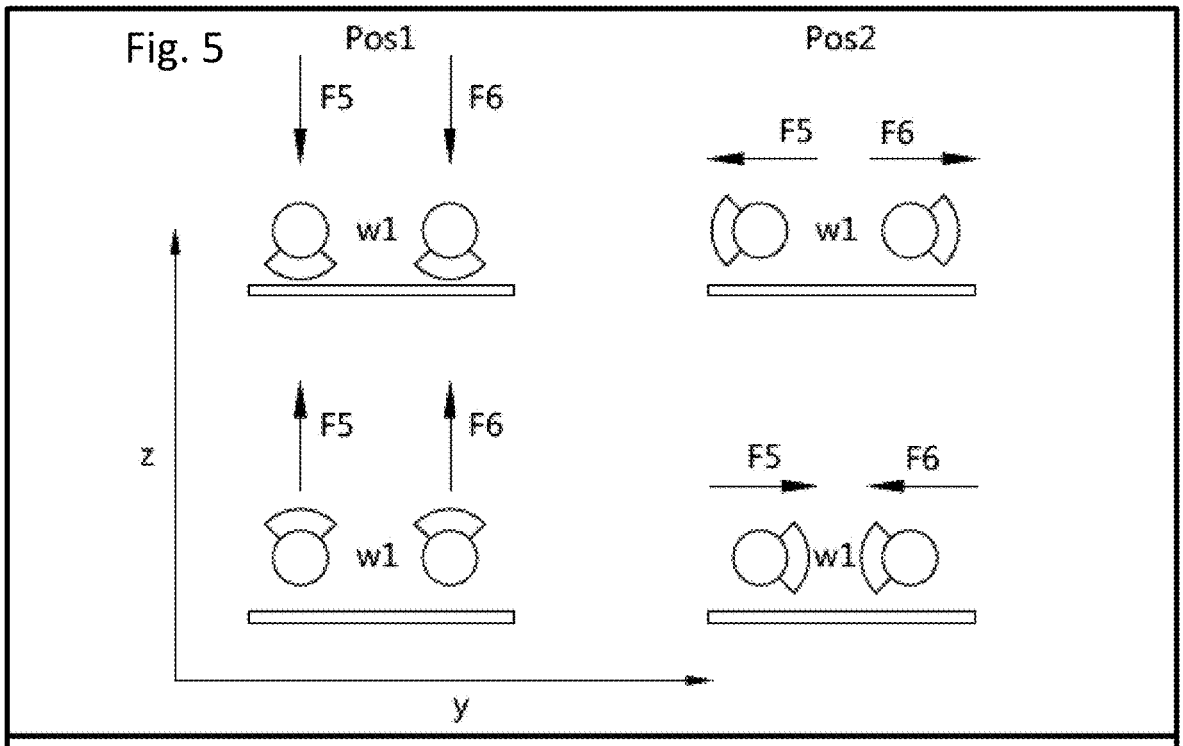
Figure 6:
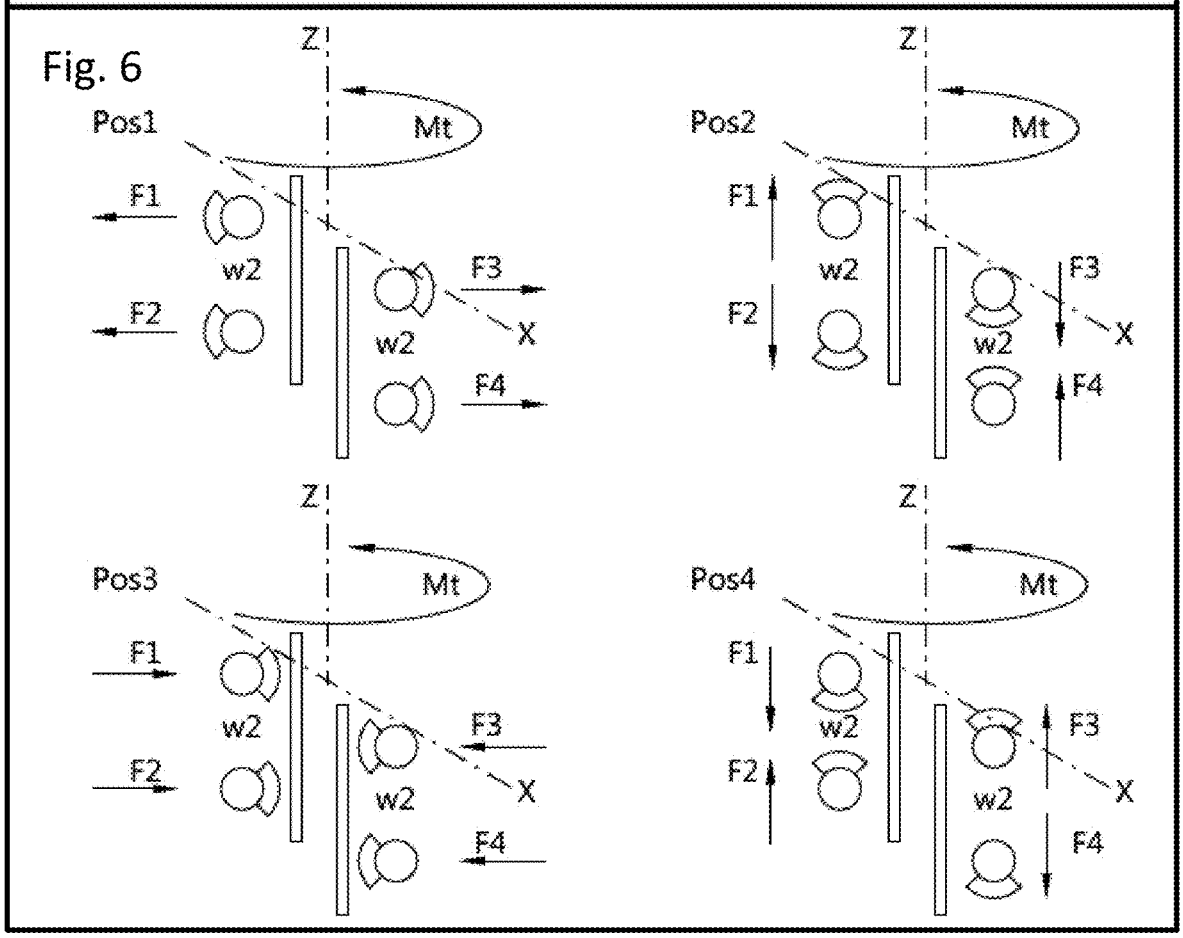

In a further embodiment FIGS. 4-6 show rotation of respective masses, forces obtained over time thereby and torsion Mt. In FIG. 4 two masses (dark sections) are provided at a top section of the shaker. These, partially disc-shaped, masses $m'_{1,1}$ and $m'_{1,2}$ rotate at angular velocity @1 along said horizontal axis $ha'_1$, therewith providing vertical vibrational forces F5 and F6. Due to the rotating masses the forces F5 and F6 vary. Further, partially disc-shaped, masses $m'_{2,1}$ and $m'_{2,2}$ rotate at angular velocity $\omega_2$ along a second horizontal axis $ha'_2$, therewith providing horizontal torsional forces F3 and F4. Likewise, partly visible, partially disc-shaped, masses $m'_{3,1}$ and $m'_{3,2}$ also rotate at angular velocity $\theta_2$ along a second horizontal axis ha'2, therewith providing horizontal torsional forces F1 and F2. In an alternative, masses $m'_{3,1}$ and $m'_{3,2}$ may rotate at angular velocity $\omega_3$ being different from angular velocity @2. Forces F1-F4 provide torsion Mt. FIG. 5 shows the direction of forces F5 and F6 depending on position of the masses $m'_{1,1}$ and $m'_{1,2}$. In the top left position 1 a sum of masses F5+F6 is downward, in the bottom left position 3 a sum of masses F5+F6 is upward, whereas in the top right and bottom right positions 2 and 4 forces F5 and F6 cancel one and another. In FIG. 6 a similar effect is shown for masses F1-F4. In the top left position 1 a sum of masses F1-F4 provide a clockwise torsion around axis z, in the bottom left position 3 a sum of masses F1-F4 provide an anti-clockwise torsion around axis z, whereas in the top right and bottom right positions 2 and 4 forces F1-F4 cancel one and another.

What is claimed is:

1. A shaker for gentle pile driving comprising a fixator for mechanically fixing a vibrator to a pile, wherein the vibrator is adapted to provide vertical vibration of the pile at a first vibration frequency and torsion to the pile at a second torsion frequency, wherein the vibrator comprises at least first and second groups of eccentric masses, each group comprising at least two equal masses, respectively referred to as a primary mass and a secondary mass, wherein each individual primary mass and secondary mass of each group is positioned at a respective $d_i$ distance away from a respective side of the vibrator, wherein the respective side of the vibrator spaces a respective mass from a center of the vibrator, wherein the first primary mass and the first secondary mass is attached to a first horizontal axel, wherein the second primary and the second secondary mass is attached to a second horizontal axel, at least one motor, wherein the at least one motor is configured for rotating the primary and secondary masses of each group around their respective horizontal axel such that the first group of masses rotates at a same first angular velocity on the first horizontal axel, and the second group of masses rotate at an opposite second angular velocity on the second horizontal axel, wherein the first angular velocity is different from the second angular velocity, and a controller for driving the at least one motor, for controlling each individual angular velocity of each respective individual group of masses, for controlling a sum of horizontal forces produced by the respective masses, and for balancing a sum of vertical forces produced by the respective masses.

2. The shaker according to claim 1, wherein a center of mass of the shaker and a rotation axis of the pile coincide.

3. The shaker according to claim 1, comprising at least one gear adapted to be driven by the at least one motor and adapted to rotate at least one mass, and wherein at least one first motor is each individually adapted to rotate the first horizontal axle at a first vibration frequency of 600-3000 rpm, and wherein at least one second motor is each individually adapted to rotate the first horizontal axle at a second torsion frequency of 900-12000 rpm.

4. The shaker according to claim 1, wherein at least one angular torsion velocity is at least two times at least one angular vibration velocity, wherein the first group comprises the first primary mass and first secondary mass and the second group comprises the second primary mass and the second secondary mass, wherein the controller is adapted to minimize a sum of vertical forces of the groups, and not to minimize a sum of horizontal forces of the groups.

5. The shaker according to claim 1, wherein a primary mass in a given group is located at a first $d_i$ distance from a vibrator side and a secondary mass in the given group is located at the same first $d_i$ distance from a vibrator side opposite of the primary mass.

6. The shaker according to claim 1, wherein the at least one motor is each individually adapted to rotate a respective horizontal axle at 600-12000 rpm.

7. The shaker according to claim 1, wherein the first primary mass and first secondary mass are located at a first e distance from the first horizontal axle, and wherein the second primary mass and second secondary mass are located at a second e distance from the second horizontal axle.

8. The shaker according to claim 7, wherein a ratio of second primary mass to first primary mass is equal to a ratio of the first e distance to the second e distance.

9. The shaker according to claim 1, comprising the first and second groups, wherein the first and the second horizontal axles are spaced at equal distance from a central point of the shaker.

10. The shaker according to claim 1, wherein one or more of the masses are disc shaped.

11. The shaker according to claim 1, wherein the masses are between 5 gr and 5000 gr, and wherein the e distances is are between 1-50 cm.

12. The shaker according to claim 1, wherein the controller drives the at least one motor such that the respective first and second masses are driven in phase.

13. The shaker according to claim 1, wherein in operation the controller is adapted to provide a vertical driving frequency of between 10 and 50 Hz, and in operation no further driving device is present.

14. The shaker according to claim 7, wherein respective first and second masses are disc-shaped and have a respective e distance and wherein a center of mass of each respective disc-shaped mass coincides with a respective horizontal axle.

* * * * *